US011852147B2

(12) United States Patent
Malone

(10) Patent No.: US 11,852,147 B2
(45) Date of Patent: Dec. 26, 2023

(54) MULTIFUNCTIONAL PUMP ASSEMBLY

(71) Applicant: COOPER-STANDARD AUTOMOTIVE INC, Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 0 days.

(21) Appl. No.: 17/712,792

(22) Filed: Apr. 4, 2022

(65) Prior Publication Data

US 2023/0313800 A1 Oct. 5, 2023

(51) Int. Cl.

| | |
|---|---|
| ***F04D 1/06*** | (2006.01) |
| ***F04D 17/12*** | (2006.01) |
| ***F04D 13/16*** | (2006.01) |
| ***F04D 29/42*** | (2006.01) |
| ***F04D 13/06*** | (2006.01) |
| ***F04D 15/00*** | (2006.01) |
| ***F04D 29/48*** | (2006.01) |

(Continued)

(52) U.S. Cl.

CPC ..... *F04D 1/06* (2013.01); *A47L 15/4221* (2013.01); *A47L 15/4225* (2013.01); *F04D 13/06* (2013.01); *F04D 13/16* (2013.01); *F04D 15/0005* (2013.01); *F04D 15/0011* (2013.01); *F04D 15/0016* (2013.01); *F04D 17/12* (2013.01); *F04D 29/426* (2013.01); *F04D 29/4293* (2013.01); *F04D 29/486* (2013.01); *F24D 3/105* (2013.01); *F04D 1/00* (2013.01); *F04D 25/06* (2013.01); *F04D 29/043* (2013.01); *F05D 2250/52* (2013.01)

(58) Field of Classification Search

CPC ..... F04D 1/06; F04D 29/4293; F04D 13/06; F04D 29/486; F04D 15/0016; F04D 13/16; F04D 1/00; F04D 15/0005; F04D 15/0011; F04D 29/426; F04D 17/12; F04D 25/06; F04D 29/043; F05D 2250/52; A47L 15/4225; A47L 15/4221; F24D 3/105

See application file for complete search history.

(56) References Cited

U.S. PATENT DOCUMENTS 1,628,841 A * 5/1927 Hollander ..... F04D 1/06 415/100
2,204,857 A * 6/1940 Hollander ..... F04D 1/10 415/167.1

(Continued)

*Primary Examiner* — Peter J Bertheaud
(74) *Attorney, Agent, or Firm* — Paschall & Associates, LLC; James C. Paschall

(57) ABSTRACT

A pump assembly is disclosed comprising a pump body having a first pump stage housed in the pump body including a fluid inlet and a first and a second fluid outlet. A flow feed chamber is housed in the pump body in fluid communication with the second fluid outlet. A second pump stage housed in the pump body is in fluid communication with the flow feed chamber and includes at least one fluid outlet connected to the second pump stage. A valve assembly is operable into a first position to fluidically connect the fluid inlet through the first pump stage to the first fluid outlet. The valve assembly is further operable into a second position to fluidically connect the first pump stage to the second fluid outlet and the flow feed chamber and the flow feed chamber fluidically connected to the at least one fluid outlet through the second pump stage.

19 Claims, 7 Drawing Sheets

(51) Int. Cl.

| | |
|---|---|
| ***F24D 3/10*** | (2006.01) |
| ***A47L 15/42*** | (2006.01) |
| ***F04D 29/043*** | (2006.01) |
| ***F04D 25/06*** | (2006.01) |
| ***F04D 1/00*** | (2006.01) |

(56) References Cited

U.S. PATENT DOCUMENTS

| | | | | |
|---|---|---|---|---|
| 3,848,800 | A * | 11/1974 | Perche | F24D 3/105 415/48 |
| 3,945,756 | A * | 3/1976 | Ikenberry | F04D 13/043 417/390 |
| 4,679,983 | A * | 7/1987 | Pietryk | F04D 29/486 415/152.2 |
| 7,100,623 | B2 * | 9/2006 | Assmann | F04D 15/0016 415/150 |
| 10,823,175 | B2 | 11/2020 | Blad et al. | |
| 2021/0003133 | A1 | 1/2021 | Blad et al. | |

* cited by examiner

MULTIFUNCTIONAL PUMP ASSEMBLY

TECHNICAL FIELD

This disclosure is generally directed to pumps. More specifically, it relates to a multifunctional pump assembly having an integrated valve that facilitates fluid flow from the pump assembly at different flowrates.

BACKGROUND

Pumps are known and commonly used to move fluids, such as coolant in a vehicle. Vehicles include cooling circuits for cooling heat-generating components of a vehicle, such as for example a vehicle's battery bank (in electric and hybrid vehicles) and a vehicle's powertrain (e.g., antifreeze for combustion engine cooling). Currently known pumps are used to circulate coolant fluids between the heat-generating components and heat dissipating devices of a vehicle such as a radiator or heat exchanger. Normal use needs of a vehicle typically require a pump to furnish a low flowrate to meet a cooling power demand to meet normal driving or mild environmental conditions. However, in certain operating conditions such as in performance driving, pulling a heavy trailer up a steep incline or during extreme environmental conditions a higher flowrate of cooling fluid must be furnished to properly cool the vehicles heat-generating components. Cooling circuit pumps are most efficient at one point for speed, flowrate, and head pressure. To meet different cooling demand conditions pumps are run at a various speeds. When flowrate needs are low pumps are run slower, with ineffective pressure, and when flowrate needs are higher pumps are run faster, with inefficient use of energy. Therefore, the cooling circuit pumps in the vehicle to meet the cooling needs for all driving and environmental conditions are ineffectively sized and operate often with a relatively high inefficient use of energy.

SUMMARY

This disclosure relates to a multifunctional pump assembly having an integrated valve that facilitates fluid flow from the pump assembly at different flowrates.

In a first embodiment a pump assembly is disclosed comprising a pump body having a first pump stage housed in the pump body. The first pump stage including a fluid inlet and a first and a second fluid outlet. A flow feed chamber is housed in the pump body in fluid communication with the second fluid outlet. A second pump stage housed in the pump body is in fluid communication with the flow feed chamber and has at least one fluid outlet connected to the second pump stage. A valve assembly is operable into a first position to fluidically connect the fluid inlet through the first pump stage to the first fluid outlet. The valve assembly is further operable into a second position to fluidically connect the first pump stage to the second fluid outlet and the flow feed chamber and the flow feed chamber fluidically connected to the at least one fluid outlet through the second pump stage.

In a second embodiment a method for pumping fluid at a first and a second flowrate is disclosed. The method comprising moving a valve assembly into a first position to fluidically connect a fluid inlet and a fluid source to a first pump stage. The first pump stage having a first and a second fluid outlet. The valve assembly first position fluidically disconnecting the first pump stage from the second fluid outlet and fluidically connecting the first fluid outlet to the first pump stage, wherein the first pump stage pumps fluid from the fluid source to the first fluid outlet at the first flowrate. The method further includes moving the valve assembly into a second position fluidically disconnecting the first pump stage from the first fluid outlet and fluidically connecting the first pump stage to the second fluid outlet and to a flow feed chamber, wherein the first pump stage pumps the fluid from the fluid source into the flow feed chamber at the first flowrate. The method additionally includes receiving by a second pump stage the fluid in the flow feed chamber, the second pump stage boosting the fluid from the flow feed chamber to at least one fluid outlet at the second flowrate.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The figures, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

An example assembly provides a multifunctional pump for a vehicle cooling circuit, which can shift between a low flow demand flowrate and a boosted high flow demand flowrate. The multifunctional pump assembly comprises a pump body, an electric motor, a rotating motor shaft, a first pump stage and impeller, and a second pump stage and impeller. A fluid inlet and first, second and third fluid outlets are disposed about the pump body. The first pump stage impeller and the second pump stage impeller are located on either side of a flow feed chamber connected to the second fluid outlet. The first pump stage impeller and the second stage pump impeller are connected to the motor shaft and rotated by the motor. The fluid inlet is in fluid communication with the first pump stage and the first and second fluid outlets. The second pump stage is in fluid communication with the flow feed chamber and the third fluid outlet. An actuator operates a valve assembly into a first position that blocks the second fluid outlet. Fluid from the fluid inlet is directed from the impeller of the first pump stage out of the first fluid outlet at the normal first flowrate. Operating the actuator into a second position sets the valve assembly to block fluid flow to the first fluid outlet diverting the fluid at the normal first flowrate to the second outlet and into the flow feed chamber. The impeller of the second pump stage receives the fluid at the first low flow demand rate from the fluid feed chamber boosting the fluid into the second high flow demand rate and out of the third fluid outlet.

Figure 1:
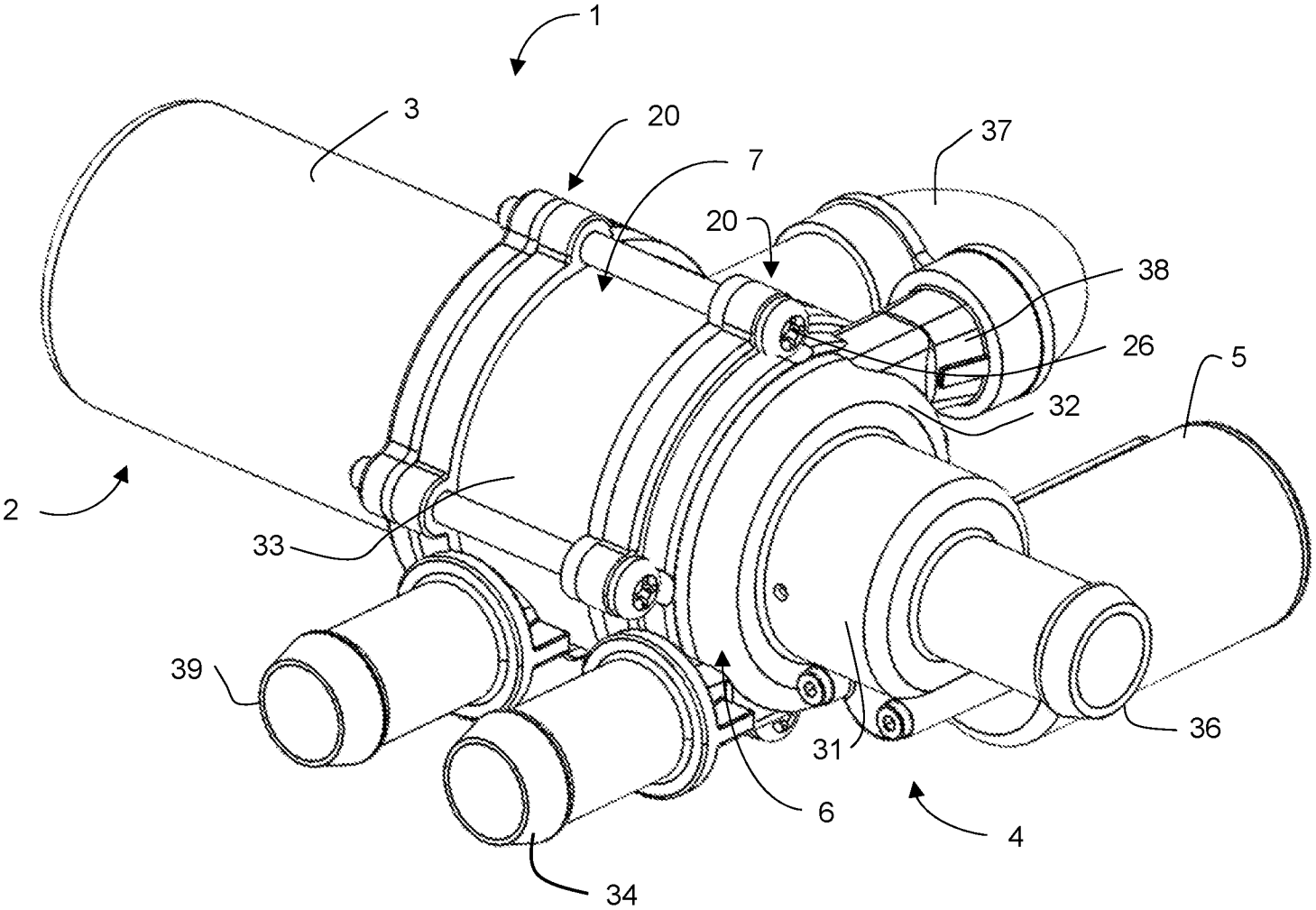
FIG. 1 illustrates a perspective view of an assembled pump assembly of the present disclosure.

FIG. 1 illustrates an example multifunctional pump assembly 1 for pumping a fluid, such as a coolant, in a vehicle. As can be appreciated, the pump assembly 1 may also be used in non-vehicle applications. The example multifunctional pump assembly 1 is an integration of a two-stage pump and a valve for selectively providing a low flow demand rate or a boosted high flow demand rate from the pump assembly 1.

Figure 2:
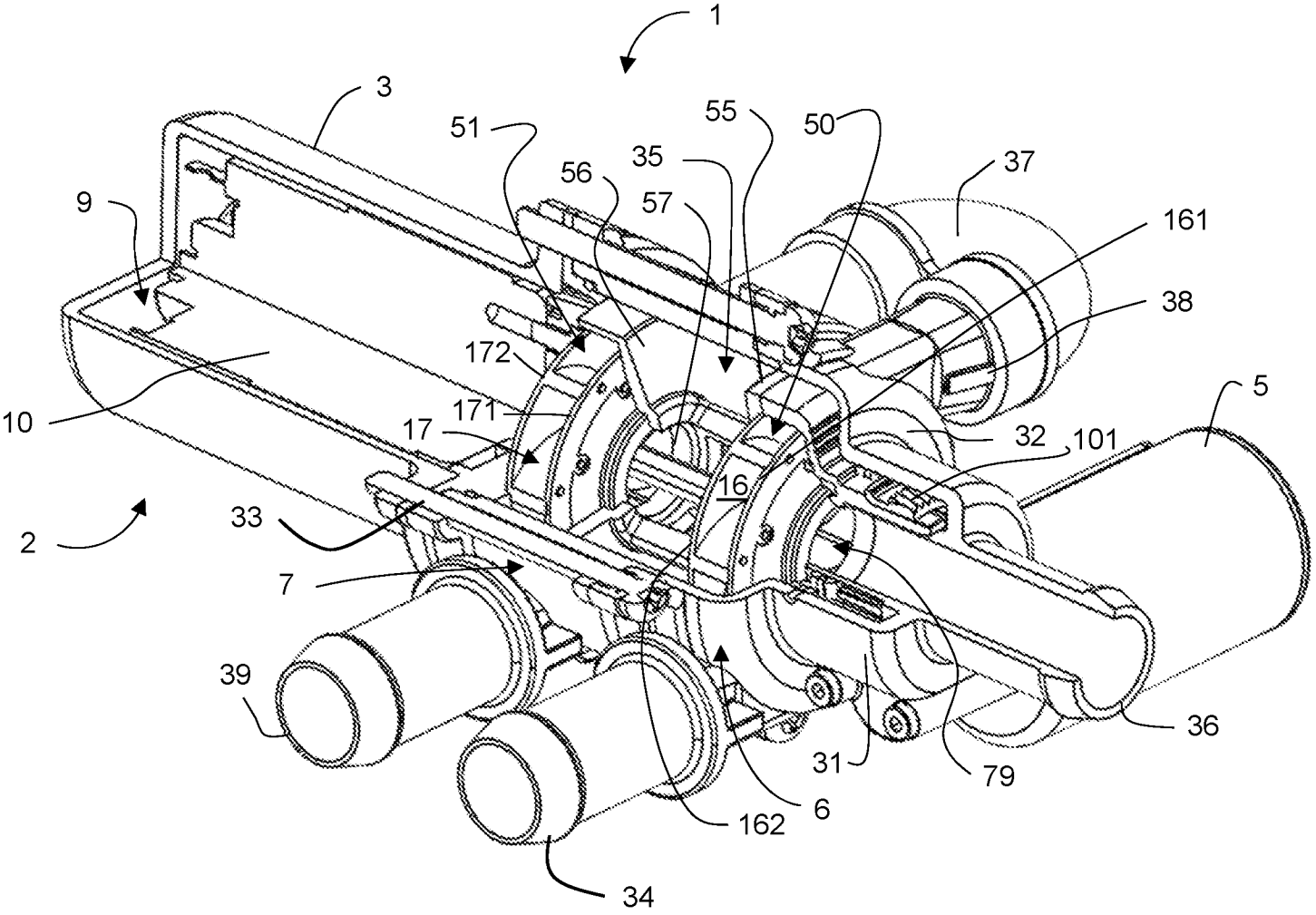
FIG. 2 illustrates a cross-sectional perspective view of the pump assembly of the present disclosure.
Figure 3:
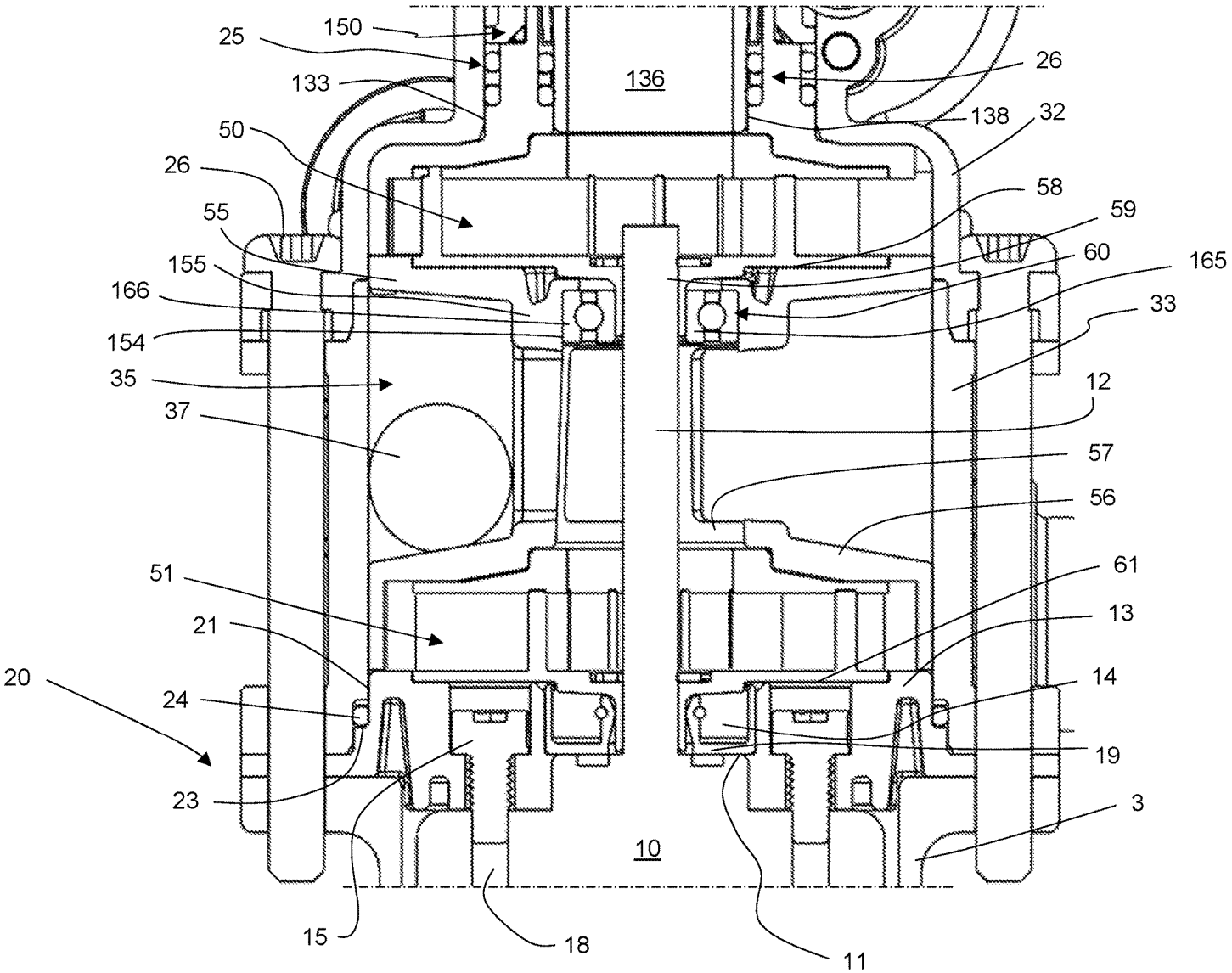
FIG. 3 illustrates a cross-sectional view through a portion of the assembled pump assembly of the present disclosure.
Figure 4:
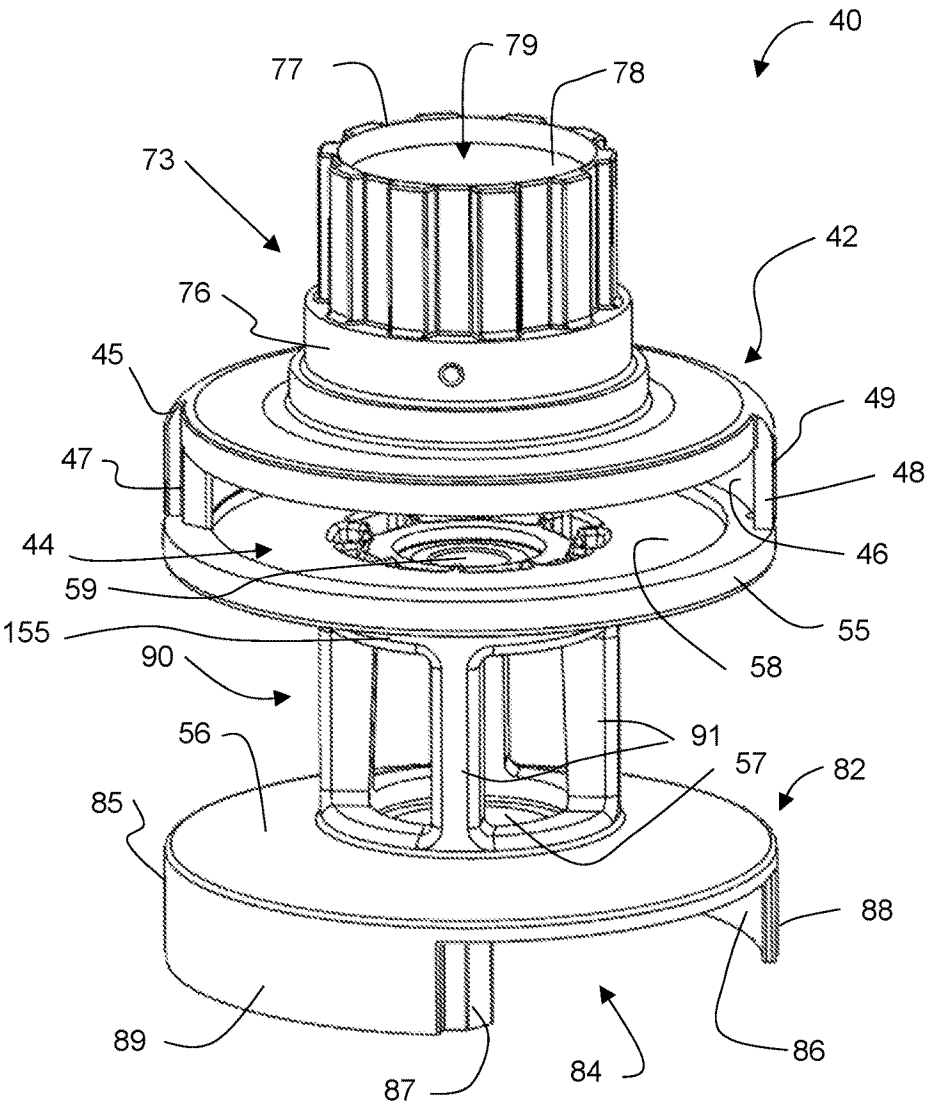
FIG. 4 illustrates a perspective view of the valve assembly of the present disclosure.

FIGS. 1-3, illustrate a pump assembly 1 having a pump motor section 2 and a pump section 4 comprised of a first pump stage 6 and a second pump stage 7. In the illustrated example of FIGS. 1 and 2, the first pump stage 6 is formed essentially cylindrical and comprises a peripheral exterior wall 32 surrounding a cylindrical first stage impeller cavity 50. A fluid inlet 36, for example a suction inlet receives a fluid, such as a vehicle coolant, is positioned centrally to the rotary axis of the first pump stage 6. The first pump stage 6 also includes at least first and second fluid outlets for discharging fluid from the first pump stage 6. A first fluid outlet 34 and a second fluid outlet 38 extend from the wall 32 orthogonal to the fluid inlet 36 and are axially offset from each other such that the centers of the first and second fluid outlets 34, 38, in the example, are oriented 180 degrees to the other. It will be appreciated by those skilled in the art, that fluid outlets 34, 38 may be offset from each other at any other convenient angle. Both fluid outlets 34, 38 are fluidly connected to the first impeller cavity 50.

The second pump stage 7 is also formed cylindrically and comprises a peripheral exterior wall 33 extending coaxially from exterior wall 32 of the first pump stage 6. Wall 33 surrounds a cylindrical second stage impeller cavity 51 and a cylindrical flow feed chamber 35. As is best seen in FIG. 3 the flow feed chamber 35 is isolated from the first impeller cavity 50 by a thimble 55. A second thimble 56 separates the flow feed chamber 35 from the second pump stage second impeller cavity 51. The second thimble 56 includes an annular aperture 57 centrally located on the thimble 56 extending through the thimble 56 into the second impeller cavity 51. Aperture 57 acts as an inlet for fluid to enter the second impeller cavity 51 from the flow feed chamber 35. The second fluid outlet 38 of the first pump stage 6 is connected to the flow feed chamber 35 via an inlet loop 37. The inlet loop 37 extending from exterior wall 33. Fluid discharged from the second fluid outlet 38 is channeled by inlet loop 37 into flow feed chamber 35. A third fluid outlet 39 extends from the wall 33 from the second impeller cavity 51.

The first impeller cavity 50 of the first pump stage 6 is arranged to house therein a first stage impeller 16 having a plurality of vanes mounted between a front vane plate 161 and a rear vane plate 162. The rear vane plate 162 is arranged to be mounted within a recess 58 of thimble 55. The recess 58 acting as a bearing surface for the impeller 16. A motor shaft 12 of a pump motor 10 extends through the flow feed chamber 35 into an opening 59 through thimble 55 and attached to impeller 16 in any known convenient manner.

The second impeller cavity 51 of the second pump stage 7 is arranged to house therein an impeller 17 having a plurality of vanes mounted between a first vane plate 171 and a rear vane plate 172. The rear vane plate 172 is arranged to be mounted within a recess 61 of a pump motor mounting plate 13. The recess 61 acting as a bearing surface for the impeller 17. The motor shaft 12 extends through a pump motor mounting plate 13 and into the flow feed chamber 35 to first stage impeller 16 of the first pump stage 6. The motor shaft 12 is attached to impeller 17 in any convenient known manner. The impeller 17 is configured to be rotatable within the second impeller cavity 51 of the second pump stage 7 driven by the pump motor 10. Since both impellers 16 and 17 are attached to the same motor shaft 12 they are both driven at the same rotational speed by the pump motor 10.

The pump motor section 2 includes a cylindrical motor housing 3 that forms a cylindrical motor cavity 9 therein. The pump motor housing 3 supports the pump motor 10 and a motor shaft 12 that is installed through an opening 11 of a pump motor mounting plate 13. The motor mounting plate 13 includes a wall 21 extending circumferentially from a top surface of the mounting plate 13. The wall 21 includes a shoulder 23 extending along and outer periphery of wall section 21. An elastomeric sealing element, such as for example an O-ring 24 is arranged to be installed on shoulder 23. A seal member 14 is installed within a seal seat 19 molded on mounting plate 13. The mounting plate 13 is secured to the pump motor 10, in this example, using threaded fasteners 15 that extend through holes in the mounting plate 13 to engage threaded holes 18 on the face of pump motor 10. The mounting plate seals the motor cavity 9 and pump motor 10 from the pump section 4. A bearing 60, preferably a ball bearing.

The first pump stage 6 is assembled to the second pump stage 7 to form pump section 4 by attaching a rear portion of the exterior housing 32 of the first pump stage 6 to a front portion of the exterior housing 33 of the second pump stage 7 by using any method that provides a leak tight bond, such as for example, welding or using sealing elements such as gaskets or O-rings.

With the mounting plate 13 mounted on the pump motor 10 mounting tabs 20 located about the motor housing 3, the mounting plate 13 and the pump section 4 are brought together and the wall 21 is installed within an interior surface of a rear portion of the second pump stage 7. The O-ring 24 seals against the interior surface of the pump section 4 and wall 21. The mounting tabs 20 are aligned with each other to assemble and secure the motor section 2 to the pump section 4 using suitable fasteners 26. As can be appreciated, other types of fastening devices or techniques may be used to secure the pump section 4 and the motor section 2 together.

The pump motor 10 includes electrical connections (not shown) that extend from a rear portion of the motor 10 through a rear portion of motor housing 3. The electrical connections are adapted to receive electrical power from a remotely located power source to energize and operate the pump motor 10.

The valve assembly 40 of the present disclosure is illustrated in FIGS. 2-5. The valve assembly 40 is comprised of an adjustable first pump stage valve member 42 that is rotatably mounted outside the first impeller 16 and inside the first impeller cavity 50 of the first pump stage 6. The first pump stage valve member 42 is arranged to adjustably direct fluid through a respective first fluid outlet 34 or second fluid outlet 38. The valve member 42 includes an annular wall 45 with an exterior wall surface 49 and an interior wall surface 46 and a rectangular opening 44 extending through wall 45. In this example, wall 45 of the valve member 42 is spirally voluted from a generally thicker wall section at a first end 47 of opening 44 to a generally thinner wall section at a second end 48 of the opening 44. The first impeller 16 is arranged to rotate inside valve member 42 and the voluted interior wall surface 46.

The valve assembly further includes an adjustable second pump stage valve member 82 that is radially mounted outside the second impeller 17 and inside the second impeller cavity 51 of the second pump stage 7. The second pump stage valve member 82 is arranged to adjustably allow or block fluid flow through the third fluid outlet 39. The valve member 82 includes an annular wall 85 with an exterior wall surface 89 and an interior wall surface 86 and a rectangular opening 84 extending through wall 85. In this example, wall 85 of the valve member 82 is spirally voluted from a generally thicker wall section at a first end 87 of opening 84 to a generally thinner wall section at a second end 88 of the opening 84. The second impeller 17 is arranged to rotate inside valve member 82 and the voluted interior wall surface 86.

Walls 85 of the valve member 82 are attached to and extend from the second thimble 56. A barrel member 90 having a plurality of equidistantly spaced ribs 91 is attached to the second thimble 56 with aperture 57 located centrally in the barrel 90 equidistant between the ribs 91. The ribs 91 of barrel member 90 extend vertically from the second thimble 56 and are attached to a lower surface of the first thimble 55. Barrel 90 is located within the flow feed chamber 35 and functions to transfer rotational displacement of the first valve member 42 to the second valve member 82. Ribs 91 of the barrel member 90 may be attached to thimble 55 and 56 using any common method such as for example snap-fit assembly or welding to permanently fix the ribs 91 to thimbles 55 and 56. Alternatively, the ribs 91 and the thimbles 55 and 56 can be molded as a unitary structure.

A bearing 60, preferably a ball bearing, aligns and stabilizes the first impeller 16, as well as the valve member 42 of the first pump stage 6. The bearing 60 mounts within an opening 154 extending from a skirt 155 in the center of thimble 55. The bearing 60 is pressed into opening 154 of the skirt 155 as shown in FIG. 3. The bearing 60 includes an outer race 166 engaging thimble 55 of first stage valve member 42 while an inner race 165 engages and stabilizes motor shaft 12. Bearing 60 supports both the high-speed rotation of the motor shaft 12 and the rotation of the valve assembly 40.

The exemplary first pump stage valve member 42 of the present disclosure further includes a cylindrical inlet member 77 located at an upper section 73 of valve member 42. The upper section 73 is arranged to be mounted within a mounting cavity 150 of a valve housing 31 that extends between the first pump stage 6 and the fluid inlet 36. The upper section 73 of the valve member 42 further includes an annular outer surface 76 and an internal passage 79 defined by an annular interior surface 78. The outer surface 76 of upper section 73 may include an exterior sealing assembly 25, shown at FIG. 5 consisting of a pair of elastomeric sealing members separated by a spacer. The exterior sealing assembly 25 is located circumferentially about the perimeter of outer surface 76. Interior surface 78 further includes an interior sealing assembly 26 consisting of another pair of sealing members separated by spacer as is shown at FIG. 3. The interior sealing assembly 26 is located parallel with and directly opposite from the exterior sealing assembly 25. The exterior and interior sealing assemblies are used to provide a fluid tight seal between the valve member 42 and the pump housing 31.

As is shown in FIG. 3, the upper section 73 of the valve member 42 is rotatably mounted within mounting cavity 150. The internal passage 79 receives a tubular portion 136 of fluid inlet 36 that directs fluid at low pressure to the first impeller 16. The exterior sealing assembly 25 seals against an interior surface 133 of mounting cavity 150. The interior sealing assembly 26 seals against surface 138 of the mounting cavity 150. The sealing assemblies 25, 26 are comprised of, for example, of O-rings fabricated from an elastomeric material such as Ethylene Propylene Diene Monomer (EPDM) rubber or the like.

Figure 5:
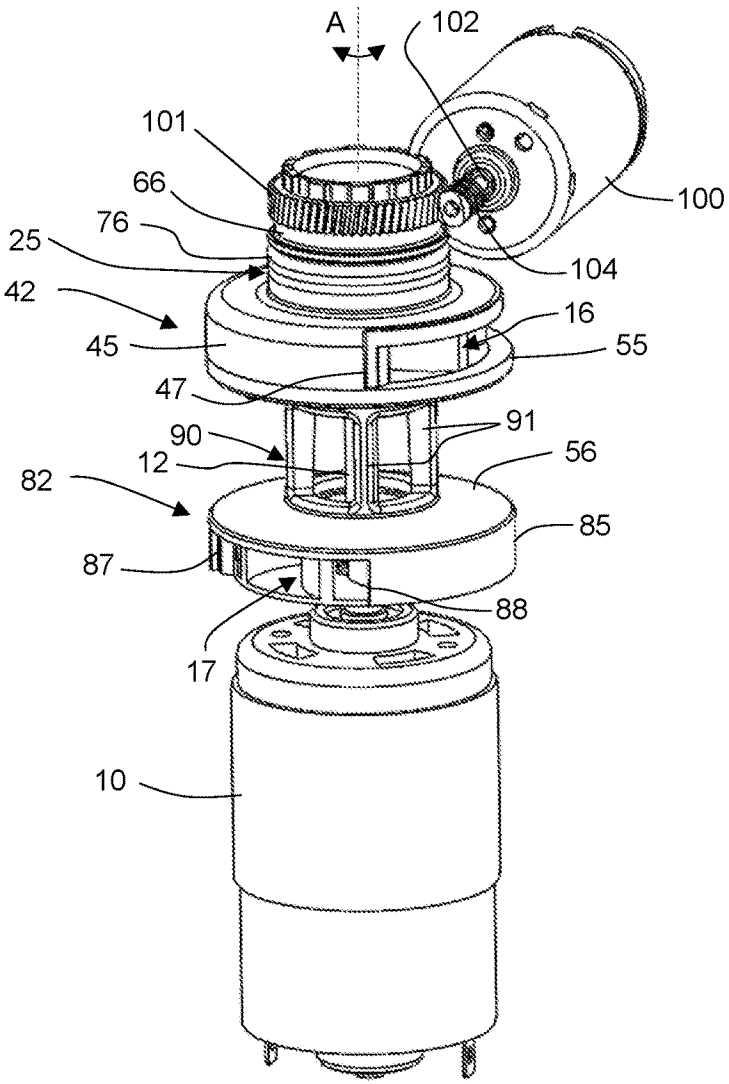
FIG. 5 illustrates a perspective view of the valve assembly, pump motor and actuator isolated from the pump housing of the present disclosure.

The upper section 73 of the valve member 42 further includes an actuation ring 66 having a spline tooth gear band 101 attached about the periphery of the outer surface 76. As is shown in FIG. 5 the teeth of the gear band 101 are arranged to be mechanically connected to a worm gear member 104 attached to a motor shaft 102 of an actuator motor 100. The valve member 42 is rotatable about a central axis A to switch fluid flow from the first impeller cavity 50 to the first fluid outlet 34 or the second fluid outlet 38, which will be explained in more detail below. The valve member 82 being attached to the valve member 42 via ribs 91 also rotates along with the rotation of valve member 42 when valve member 42 is rotated by actuator motor 100.

With reference to FIGS. 1 and 2, the actuator motor 100 of the present disclosure is arranged to be housed within an actuator motor housing 5 of the pump section 4. The actuator motor housing 5 is integrally formed with the actuator housing 31, such as by injection molding. The actuator motor 80 is electrically connected to a remotely located controller through an electrical circuit section (not shown) on a rear face of the actuator motor 100 using an electrical connector. The controller selectively signals the actuator motor 100 to rotate motor shaft 102.

Rotation of the valve assembly 40 selectively positions the first pump stage valve member 42 to divert fluid flow from the first impeller cavity 50 to either the first or the second fluid outlets 34, 38. Simultaneously, rotation of the valve assembly 40 selectively positions the second pump stage valve member 82 to block or allow fluid flow from the second impeller cavity 51 to the third fluid outlet 39.

Figure 6B:
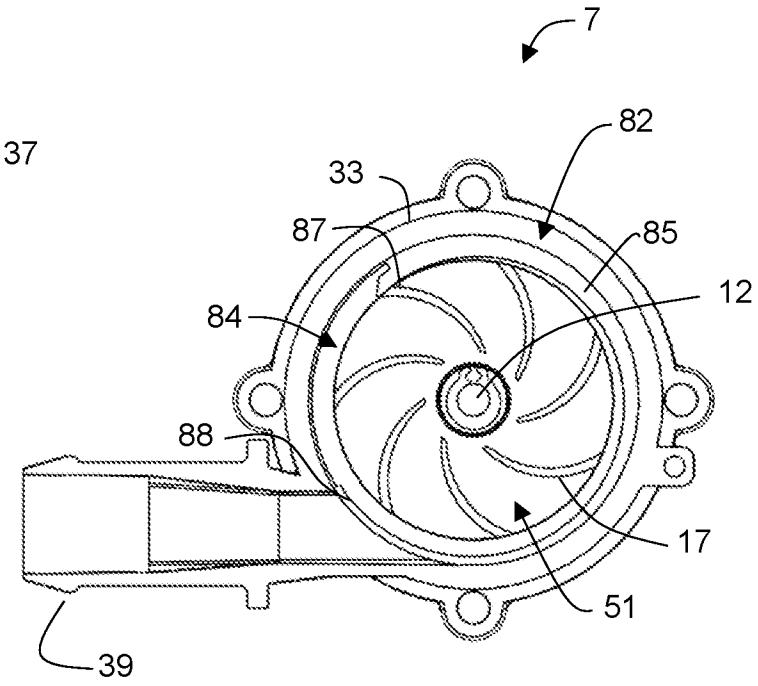
FIG. 6B illustrates a cross-sectional view of a portion of the second pump stage of the present disclosure, with the valve assembly in the first position.
Figure 6A:
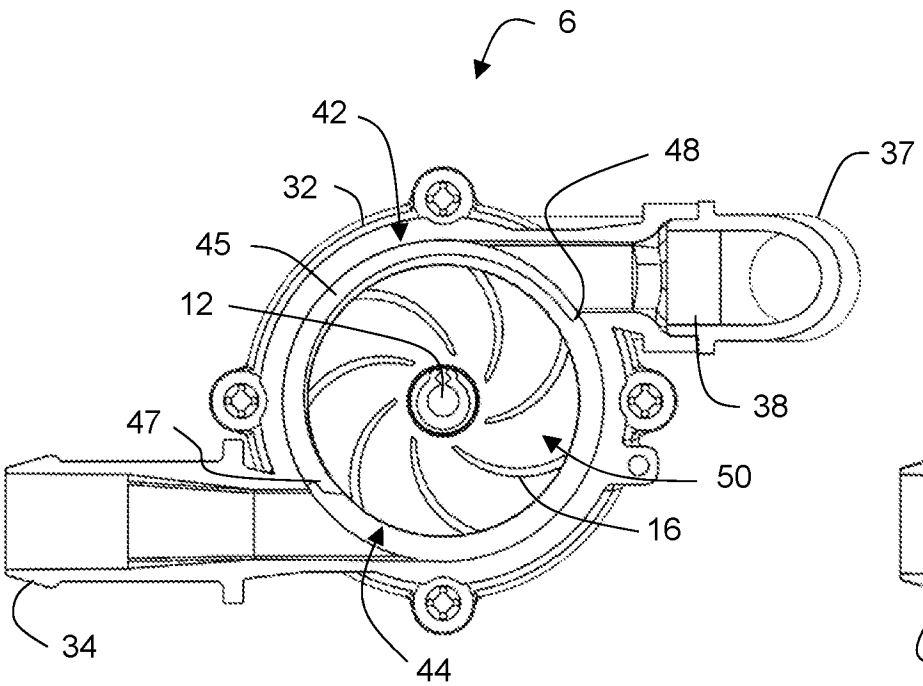
FIG. 6A illustrates a cross-sectional view through a portion of the first pump stage of the present disclosure, with the valve assembly in the first position.

With reference to FIGS. 6A and 6B, the operation of the first pump stage valve member 42 and the second pump stage valve member 82 will now be explained. FIG. 6A illustrates schematically a section through the first pump stage 6. The first impeller cavity 50 of the first pump stage 6 includes impeller 16 rotating within valve member 42 driven attached to motor shaft 12 and driven by pump motor 10. The impeller 16 receives fluid from fluid inlet 36 through tubular portion 136 extending through cavity 79 of the valve member 42. The impeller 16 driving the fluid introduced into the first impeller cavity 50.

In FIG. 6A the actuator 100 selectably rotates the actuation ring 66 of valve member 42 to position the opening 44 of valve member 42 into a first position that aligns opening 44 with the first fluid outlet 34. In the first position fluid driven by the impeller 16 is diverted entirely through the first fluid outlet 34 at the normal flowrate. Wall 45 of the valve member 42 closing off and obstructing flow of the fluid in the first impeller cavity 50 to the second fluid outlet 38 FIG. 6B illustrates schematically a section through the second pump stage 7. As was explained earlier, valve member 42 is physically fixed to valve member 82 by ribs 91 of barrel member 90. Therefore, rotation of valve member 42 by actuator 100 transfers the rotation to valve member 82, simultaneously, turning both valve members 42 and 82 synchronously.

In FIG. 6B the second impeller 17 attached to motor shaft 12 rotates within valve member 82 driven by pump motor 10. Second impeller 17 rotates at the same rotational speed as first impeller 16. In the first position, wall 85 of the valve member 82 closes off the third fluid outlet 39. As was explained earlier the second impeller cavity 51 receives fluid from the flow feed chamber 35 through aperture 57 of thimble 56. With wall 45 blocking the second fluid outlet 38 from the first impeller cavity 50 of the first pump stage 6, no fluid is driven into flow feed chamber 35. Additionally, the third fluid outlet 39 is blocked by wall 85 preventing any residual fluid left in the fluid flow chamber 35 from being discharged from the third fluid outlet 39. As will be appreciated by those skilled in the art, with the valve assembly 40 in the first position, fluid is only pumped out of the first pump stage 6 first fluid outlet 34 coinciding with the normal first flowrate from the pump assembly 1.

Figure 7B:
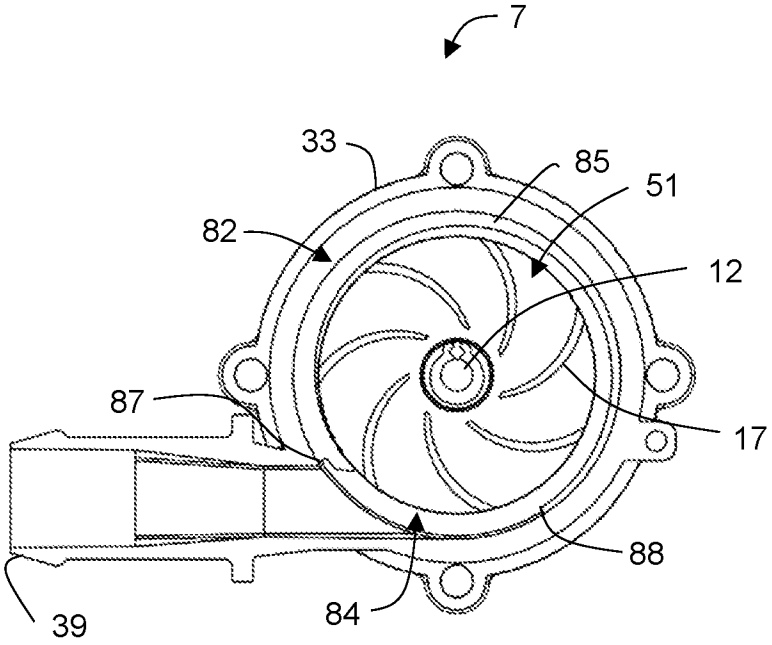
FIG. 7B illustrates a cross-sectional view through a portion of the second pump stage of the present disclosure, with the valve assembly in the second position.
Figure 7A:
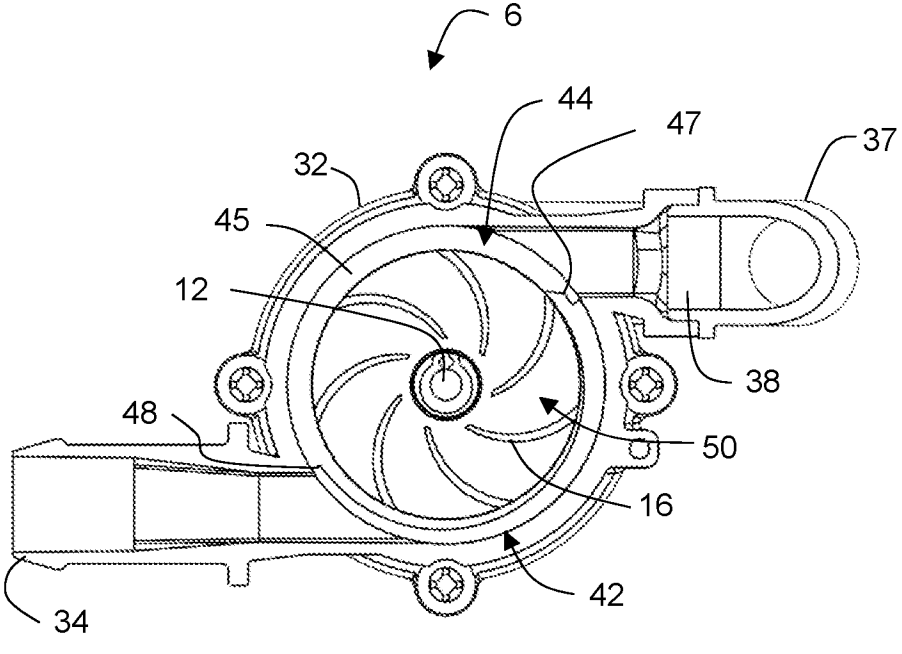
FIG. 7A illustrates a cross-sectional view of a portion of the first pump stage of the present disclosure, with the valve assembly in the second position.

Rotation of the valve assembly 40 by actuator 100 positions the valve assembly 40 into a second position. As is shown in FIG. 7A, rotation of the valve assembly 40 into the second position moves valve member 42 wall 45 to block fluid outlet 34 and positioning opening 44 in alignment with second fluid outlet 38. Fluid introduced into the first pump stage 6 first impeller cavity 50 from fluid inlet 36 is pumped from the first impeller cavity 50 by first impeller 16 at the normal flowrate through the second fluid outlet 38 and into loop 37. Loop 37 feeds the fluid to the flow feed chamber 35. In the second pump stage 7 valve member 82 opening 84 aligns with fluid outlet 39 as illustrated in FIG. 7B. The fluid in the flow feed chamber 35 is pumped into the flow feed chamber 35 from the first pump stage 6 at the first flowrate. The fluid enters the second impeller cavity 51 through aperture 57 and is boosted by the rotational speed of the second impeller 17. The boosted high flowrate exiting the second pump stage second impeller cavity 51 via the third fluid outlet 39.

Even though the present disclosure has been explained using first and second pump stages, more than the two pump stages illustrated may be used to boost the flowrate from the pump assembly. For example, a third and a fourth pump stage can be attached to the first and second pump stages disclosed each having a flow feed chambers, impellers and valve assemblies that would provide successive boosts in fluid flowrates, from the normal flowrate of a first pump stage.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A pump assembly comprising:

a pump body;

a first pump stage housed in the pump body having a fluid inlet and a first and a second fluid outlet;

a flow feed chamber housed in the pump body in fluid communication with the second fluid outlet;

a second pump stage in fluid communication with the flow feed chamber housed in the pump body, the second pump stage having at least one fluid outlet; and a valve assembly operable into a first position to fluidically connect the fluid inlet through the first pump stage to the first fluid outlet and prevent a fluid connection to the at least one fluid outlet from the second pump stage and the valve assembly operable into a second position to fluidically connect the first pump stage to the second fluid outlet and the flow feed chamber, wherein the flow feed chamber is fluidically connected to the at least one fluid outlet through the second pump stage.

2. The pump assembly of claim 1, wherein In the first position the valve assembly prevents a fluid connection to the second fluid outlet from the first pump stage.

3. The pump assembly of claim 1, wherein in the second position the valve assembly prevents a fluid connection to the first fluid outlet from the first pump stage.

4. The pump assembly of claim 1, wherein the assembly further includes;

a motor having a motor shaft;

a first impeller located in the first pump stage driven by the motor shaft; and a second impeller located in the second pump stage driven by the motor shaft.

5. The pump assembly of claim 4, wherein the motor drives the first impeller and the second impeller at the same rotational speed.

6. The pump assembly of claim 4, wherein the fluid inlet is connected to a fluid source, wherein in the valve assembly first position the first impeller drives the fluid from the fluid source and the first pump stage to the first fluid outlet at a first flowrate.

7. The pump assembly of claim 6, wherein in the valve assembly second position the first impeller drives the fluid from the fluid source and the first pump stage to the second fluid outlet and the flow feed chamber at the first flowrate.

8. The pump assembly of claim 7, wherein, in the valve assembly second position the second impeller drives the fluid in the flow feed chamber from the second pump stage to the at least one fluid outlet at a second flowrate.

9. The pump assembly of claim 8, wherein the second flowrate is greater than the first flowrate.

10. The pump assembly of claim 4, wherein the valve assembly is driven into the first and the second position by an actuator.

11. The pump assembly of claim 10, wherein the actuator is an electrical motor.

12. The pump assembly of claim 10, wherein the valve assembly includes a first valve member rotationally mounted between the first impeller and the first and second outlets of the first pump stage, the first valve member including a peripheral wall having an opening through the wall for fluidically connecting the first or the second fluid outlets to the impeller.

13. The pump assembly of claim 12, wherein the actuator rotates the first valve member to the first position aligning the first valve opening to fluidically connect the first impeller to the first fluid outlet and the first valve member wall to fluidically disconnect the first impeller from the second fluid outlet.

14. The pump assembly of claim 12, wherein the actuator rotates the first valve member to the second position aligning the first valve opening to fluidically connect the first impeller to the second fluid outlet and the first valve member wall to fluidically disconnect the first impeller from the first fluid outlet.

15. The pump assembly of claim 12, wherein the valve assembly includes a second valve member fixed to the first valve member and rotationally mounted between the second impeller and the at least one fluid outlet of the second pump stage, the second valve member including an aperture extending through a thimble mounted to a top surface of the second valve member, the aperture fluidically connecting the second impeller to the flow feed chamber, the second valve member further including a peripheral wall having an opening through the wall for fluidically connecting the at least one fluid outlet to the second impeller.

16. The pump assembly of claim 15, wherein the second valve member is rotated to the first valve position when the actuator rotates the first valve member to the first position the second valve member wall fluidically disconnecting the second impeller of the second pump stage from the at least one fluid outlet.

17. The pump assembly of claim 15, wherein the second valve member is rotated to the second valve position when the actuator rotates the first valve member to the second position the second valve opening fluidically connecting the second impeller of the second pump stage to the at least one fluid outlet.

18. The pump assembly of claim 15, wherein the first valve member includes a thimble attached to the first valve member bottom surface the first valve member thimble including a bearing fixed to the motor shaft and the first valve member thimble, the first valve member thimble connected to the second valve member thimble via a plurality of ribs oriented about the second valve member thimble aperture, the ribs located in the flow feed chamber.

19. A method for pumping fluid at a first and a second flowrate, the method comprising;

moving a valve assembly into a first position to fluidically connect a fluid inlet and fluid source to a first pump stage having a first and a second fluid outlet and prevent a fluid connection to at least one fluid outlet from a second pump stage, the first position fluidically disconnecting the first pump stage from the second fluid outlet and fluidically connecting the first fluid outlet to the first pump stage, wherein the first pump stage pumps fluid from the fluid source to the first fluid outlet at the first flowrate;

moving the valve assembly into a second position making a fluid connection to the at least one fluid outlet at the second pump stage and fluidically disconnecting the first pump stage from the first fluid outlet and fluidically connecting the first pump stage to the second fluid outlet and to a flow feed chamber, wherein the fluid is pumped from the first pump stage from the fluid source into the flow feed chamber at the first flowrate; and receiving by the second pump stage the fluid in the flow feed chamber, the second pump stage boosting the fluid from the flow feed chamber to the at least one fluid outlet at the second flowrate.

* * * * *